United States Patent [19]

Tibbitts

[11] Patent Number: 4,883,132

[45] Date of Patent: Nov. 28, 1989

[54] DRAG BIT FOR DRILLING IN PLASTIC FORMATION WITH MAXIMUM CHIP CLEARANCE AND HYDRAULIC FOR DIRECT CHIP IMPINGEMENT

[75] Inventor: Gordon A. Tibbitts, Salt Lake City, Utah

[73] Assignee: Eastman Christensen, Salt Lake City, Utah

[21] Appl. No.: 243,135

[22] Filed: Sep. 9, 1988

Related U.S. Application Data

[63] Continuation of Ser. No. 106,793, Oct. 13, 1987, abandoned.

[51] Int. Cl.[4] ..... E21B 7/18; E21B 10/60

[52] U.S. Cl. ..... 175/65; 175/329; 175/393

[58] Field of Search ..... 175/393, 330, 329, 65

[56] References Cited

U.S. PATENT DOCUMENTS

| | | | |
|---|---|---|---|
| 1,945,160 | 1/1934 | Pearce | 175/393 |
| 2,357,835 | 9/1944 | Leissler | 175/393 |
| 3,059,708 | 10/1962 | Cannon et al. | 175/393 |
| 4,341,273 | 7/1982 | Walker et al. | 175/393 |
| 4,352,400 | 10/1982 | Grappendorfer et al. | 175/330 |
| 4,440,247 | 4/1984 | Sartor | 175/393 |

FOREIGN PATENT DOCUMENTS

| | | | |
|---|---|---|---|
| 533719 | 10/1976 | U.S.S.R. | 175/394 |
| 663834 | 5/1979 | U.S.S.R. | 175/393 |
| 794147 | 2/1981 | U.S.S.R. | 175/393 |
| 2181173 A | 4/1987 | United Kingdom . | |

OTHER PUBLICATIONS

"Stratapax Drill Blanks", by General Electric, Oct. 1982.

*Primary Examiner*—Hoang C. Dang
*Attorney, Agent, or Firm*—Joseph A. Walkowski; Michael L. Lynch

[57] ABSTRACT

An improved bit and method for cutting plastic and sticky rock formations, which tend to cause bit balling, is provided by a drag bit having a cutting face formed of a plurality of generally radially extending open arched blades. Each arched blade is provided with a cutting face and defines a cavity beneath the arched to the bit body. In a preferred embodiment, the cutting elements on the arched blade are a plurality of synthetic polycrystalline diamonds which are cut, sized and shaped to comformally fit with each other so as to present a substantially diamond-only surface as a cutting surface of the bit. Hydraulic nozzles are defined in the bit body beneath and azimuthally behind the arches formed by each blade. The nozzles direct hydraulic flow across the cavity under the arch and across each portion of the cutting face on the arch. As a result, when cutting, substantially only a diamond surface is provided for shearing the rock formation or contacting with velocity any portion of the plastic rock formation. Once the rock chip is exuded upwardly across the diamond face of the cutter, it is subjected to a directed hydraulic flow which peels the chip from the diamond face and transports it into the open cavity defined underneath the arched blade. The cavities under the arched blade form an open toroidal space around the bit and freely communicate with a plurality of large open waterways and junk slots. Large plastic fragments may then be cut, peeled from the face of the diamond cutters, and flushed through the waterways up the junk slots.

19 Claims, 5 Drawing Sheets

DRAG BIT FOR DRILLING IN PLASTIC FORMATION WITH MAXIMUM CHIP CLEARANCE AND HYDRAULIC FOR DIRECT CHIP IMPINGEMENT

This application is a continuation of application Ser. No. 106,793, filed 10/13/87, now abandoned.

BACKGROUND OF THE INVENTION

1. Field of the Invention

The invention relates to the field of earth boring tools and more particularly to rotating drag bits used in shale or highly plastic formations.

2. Description of the Prior Art

Drilling in shales or plastic formations with a drag bit has always been difficult. The shale, under pressure and in contact with hydraulics, tends to act like a sticky bubble-gum-like mass, sometimes referred to as gumbo, which balls and clogs the bit. Once the bit balls up, it ceases to cut effectively.

Barr et. al., "Improvements in or relating to rotary drill bits," UK Patent GB 2 181 173 A shows a bladed drag bit with a plurality of cutters on each blade in combination with a nozzle which creates a vortex flow having a peripheral stream extending across the cutting elements and exiting into a gage region. However, the cutters are spaced cutters and the nozzle is azimuthally disposed in front of the blade. The flow from each nozzle is isolated from the flow of other nozzles in the bit by the solid mass of the adjacent blades. This is likely to result in isolation of the hydraulics of each vortex pattern, presents a noncutting bit surface between the cutters to the sticky formation, and does not provide for a directed hydraulic impingement on the chips which has any tendency to peel the adhesive chips from the cutter face.

Numerous solutions have been attempted involving large cutters, aggressive cutting patterns, aggressive hydraulics and directed hydraulics all in an attempt to prevent adhesion of the chips to the bit face.

While many of the prior art attempts have been successful in one degree or another, efficient drilling rates have always been difficult to achieve consistently in all types of plastic formations, with all types of hydraulic formulations and in all types of drilling conditions.

Therefore, what is needed is a bit design for use in shale or plastic formations which is highly efficient in a broad range of conditions and environments.

BRIEF SUMMARY OF THE INVENTION

The invention is a drag bit comprising a bit body, a plurality of blades formed with the bit body and extending therefrom, and at least one cutting element and preferably a plurality of cutters on each blade. Each of the cutters preferably has a diamond cutting face. The plurality of cutters is arranged and configured on each blade so that the cutters provide a primary cutting surface. The primary cutting surface may be characterized as a substantially diamond-only surface which is believed to reduce the probability for adhesive contact between the cutters and plastic rock formation. Each blade defines a cavity between the blade and the body of the bit. In the preferred embodiment, the cavity permits azimuthal flow of material therethrough.

As a result, an all-diamond cutting surface only is presented to the rock formation and hydraulic removal is enhanced to avoid bit balling.

The bit further comprises at least one nozzle disposed in the bit body below each of the blades. The nozzle directs a flow of hydraulic fluid across the cavity and the plurality of cutters disposed on the corresponding blade.

In the preferred embodiment, each nozzle is disposed in the bit body behind the diamond faces of the corresponding plurality of cutters with respect to the direction of normal rotation of the bit during drilling.

In the preferred embodiment at least two nozzles per blade are disposed in the bit body. Each nozzle has a hydraulic flow primarily directed to a different portion of the plurality of cutters on the corresponding blade. The nozzles may include specialized nozzle elements or be simple ports.

The plurality of cutters on each of the blades are shaped to conform each to an adjacent one of the cutters on the blade to leave substantially no other surface exposed between adjacent cutters.

In a first embodiment each of the cutters has a circular diamond face. Selected ones of the plurality of cutters are moon-cut to conformally fit to circular adjacent cutters.

In another embodiment the cutters are semicircular and at least one of the semicircular cutters is inverted relative to an adjacent semicircular cutter. The adjacent cutters has the straight side segment of the semicircular shape disposed in opposing directions as compared to a the adjacent cutter.

In yet another embodiment at least two of the cutters have a generally rectangular shape to permit conformal abutment of the two rectangularly shaped cutters adjacent to each other.

In still yet another embodiment at least two of the cutters have a triangular shape. The triangular shaped cutters are inverted relative to each other to permit abutment of two triangular sides of the adjacent cutters next to each other.

The invention can also be characterized as an improvement in a drag bit for cutting a plastic rock formation. The bit has a bit face, gage and bit body. The improvement comprises a plurality of arched blades extending from the gage of the bit to the apex of the bit. A corresponding plurality of open cavities are defined between the arched blades and the bit body. The cavities freely permit circumferentially oriented flow of fluid and fragments of rock formation therethrough. A plurality of nozzles are disposed in the bit for directing hydraulic flow across selected portions of the arched blades. At least one and preferably a plurality of cutters are disposed on each of the arched blades forming the bit face.

As a result, the plastic rock formation is efficiently cut in a wide variety of conditions.

Each of the cutters comprises a diamond cutting face and the hydraulics directed by the corresponding plurality of nozzles directs hydraulic flow across the diamond faces to cool the diamond faces and remove fragments of the plastic rock formation therefrom.

At least some of the diamond faces of the plurality of cutters are sized and shaped so that the plurality of diamond faces on each blade conformally fit with adjacent diamond faces of an adjacent cutter to present a substantially diamond-only cutting face.

The plurality of nozzles directs a fluid flow from a position behind the diamond faces of the cutters as defined by normal rotation of the bit when drilling.

The plurality of nozzles is preferably positioned in the bit body behind a corresponding one of the arched blades as defined by rotation of the bit in drilling and each of the nozzles directs a flow across the cavity from behind each of the cutters and across the diamond face of the cutters.

The invention is also a method for preventing bit balling in the cutting of a plastic rock formation comprising the steps of presenting a substantially diamond-only surface as a cutting surface to the plastic rock formation. The rock formation is cut with the substantially diamond-only cutting surface. The rock fragments cut by the cutting surface are removed by a directed hydraulic flow. The hydraulic flow for removing the rock fragments cut by the cutting surface is directed in a direction from a point of origin behind the cutting surface as defined by normal rotation of the bit when cutting.

As a result, adhesion of the plastic rock formation fragments to the bit is substantially avoided.

In the step of directing the hydraulic flow from a point of origin behind the cutting face, the hydraulic flow is directed to impinge on the rear surface of the fragments of the plastic formation as the fragments clear the cutting face and extend into a cavity above the cutters. The method further comprises the step of breaking the fragment by the directed hydraulic flow and removing the broken fragment from the proximity of the bit by hydraulic transport.

In the step of removing the rock fragments cut by the cutters, the rock fragments are removed by the directed hydraulic flow by transport of the rock fragments into a space openly communicating with an annulus between the bit and a borehole in which the bit is disposed. This space is characterized as being several times greater in each dimension than the maximum dimension of any fragment cut from the rock formation and extends from the face of the bit to a predetermined level on the bit body.

Turn now to the following drawings of the invention wherein like elements are referenced by like numerals.

BRIEF DESCRIPTION OF THE DRAWINGS

Turn now to the following detailed description in which like elements are referenced by like numerals.

DETAILED DESCRIPTION OF THE PREFERRED EMBODIMENTS

An improved bit and method for cutting plastic and sticky rock formations, which tend to cause bit balling, is provided by a drag bit having a cutting face formed of a plurality of generally radially extending open arched blades. Each arched blade is provided with a cutting face and defines a cavity beneath the arch to the bit body. The cutting elements on the arched blade may include a plurality of synthetic polycrystalline diamonds which are cut, sized and shaped to conformally fit with each other so as to present a substantially diamond-only surface as a cutting surface of the bit. Hydraulic nozzles are defined in the bit body beneath and behind the arches formed by each blade. The nozzles direct hydraulic flow across the cavity under the arch and across each portion of the cutting face on the arch. As a result, when cutting, only a diamond surface is provided for shearing the rock formation or contacting with velocity any portion of the plastic rock formation. Once the rock chip is exuded upwardly across the diamond face of the cutter, it is subjected to a directed hydraulic flow which peels the chip from the diamond face and transports it into the open cavity defined underneath the arched blade. The cavities under the arched blade freely communicate with a plurality of large open waterways and junk slots. Large plastic fragments may then be cut, peeled from the face of the diamond cutters, and flushed through the waterways up the junk slots.

Figure 1:
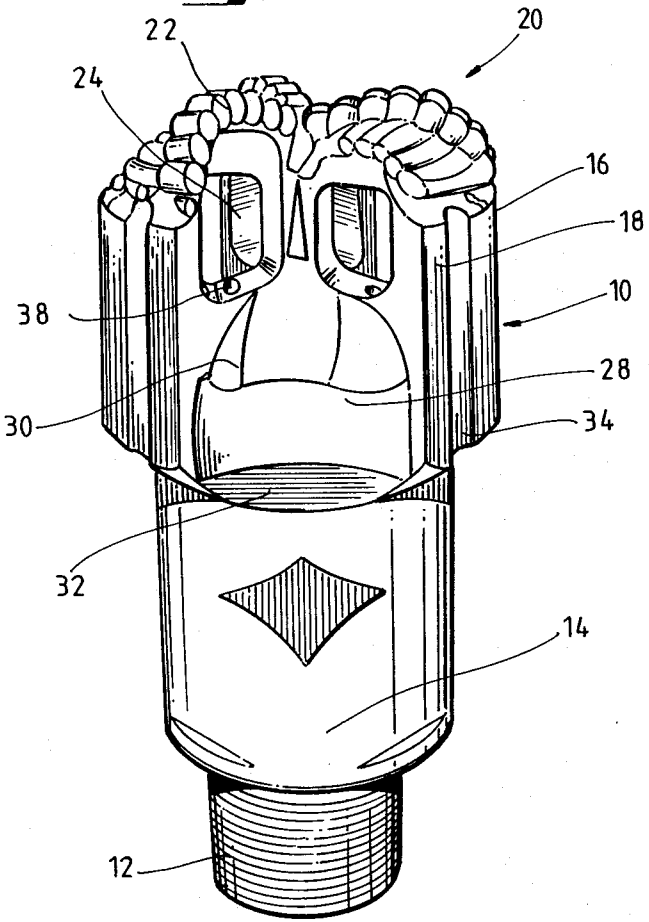
FIG. 1 is a perspective view of a completed drag bit incorporating the invention.

FIG. 1 is a perspective illustration of a completed drag bit of the preferred embodiment fabricated through molding according to the invention using conventional metal matrix infiltration methodology. Drag bit 10 is characterized by a threaded portion 12 on the upper end of the shank (inverted in FIG. 1 for ease of visualization). Threaded portion 12 is integral with shank 14 and shank 14 is integral with bit body 16. Bit body 16 is comprised of gage 18 and, in the illustrated embodiment, three blades 20. The number of blades is not material to the invention.

Figure 3:
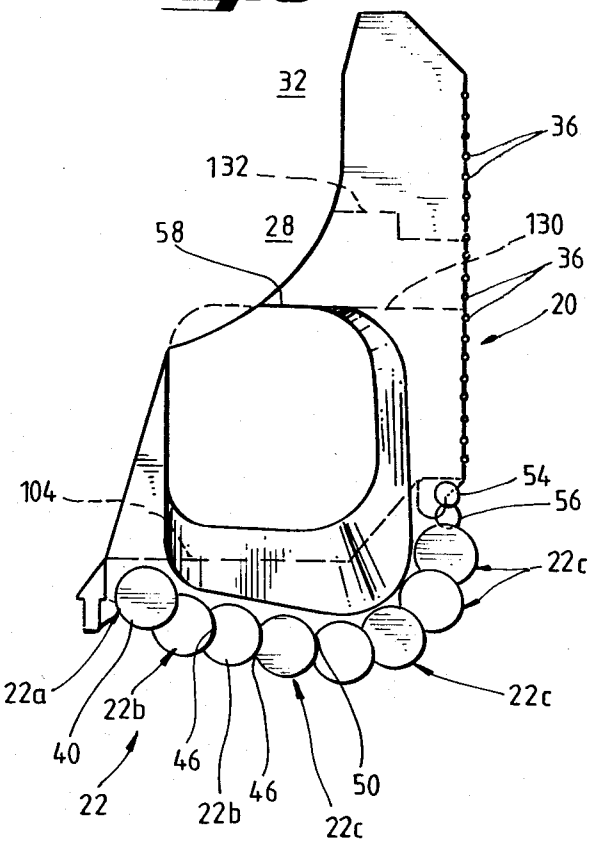
FIG. 3 is a diagrammatic profile of one of the cutting blades of the bit illustrated in FIGS. 1 and 2.

As shown in FIGS. 1 and 3, on each blade 20 is a plurality of synthetic polycrystalline diamond slug cutters 22 formed on the top of the arch comprised by blade 20. Cutters 22 extend from the center of bit 10 to its gage 18. Each blade forms a web characterized by an open cavity 24. Between blades 20 is an open space which forms a large open waterway 26 and face junk slot 28. The demarcation between waterway 26 and face junk slot 28 is somewhat arbitrary, but face junk slot 28 is generally the region adjacent the face 30 of bit body 16 and proximate the lower portion of waterway 26. Face junk slot 28 communicates with upper junk slot 32 which in turn extends to the upper part of the gage (again FIG. 1 being inverted for ease of visualization, necessarily has upper junk slot 32 depicted below face junk slot 28 and waterway 26 in the depiction of FIG. 1). Gages 18 also includes a plurality of longitudinal broaches 34 and ribs bearing gage diamond kickers 36. Kickers 36 are typically comprised of embedded natural diamonds or fragments of worn synthetic diamonds.

In the bottom of each cavity 24 are one or more nozzles 38 which direct hydraulic fluid from behind and upwardly across the face of cutters 22. The position of nozzles 38, cutters 22, blades 20 and waterways 26 can be better understood and visualized by now turning to the plot sketch of FIG. 2. The plot sketch is a diagrammatic plan view of bit 10 of FIG. 1. In the illustrated embodiment, cutters 22 are compax cutters which typically are comprised of a polycrystalline synthetic diamond table 40, mounted, bonded or otherwise fixed to a metallic backing slug 42 which in turn is set within a cutter body 44 manufactured as part of the infiltration molding process. It is to be expressly understood that many other types of cutting elements or diamond cutters, e.g. natural diamond thermally stable polycrystalline diamond or bonded stud cutters, could be substituted without departing from the spirit and scope of the invention. In the illustrated embodiment, each diamond table 40 is in the shape of a generally circular disc approximately one inch or more in diameter. It is also contemplated that fractions of a circular cutter may be used, such as half circular cutting elements. As will be described below, many other types, shapes and sizes of cutters may be employed according to the invention without departing from its scope.

Figure 2:
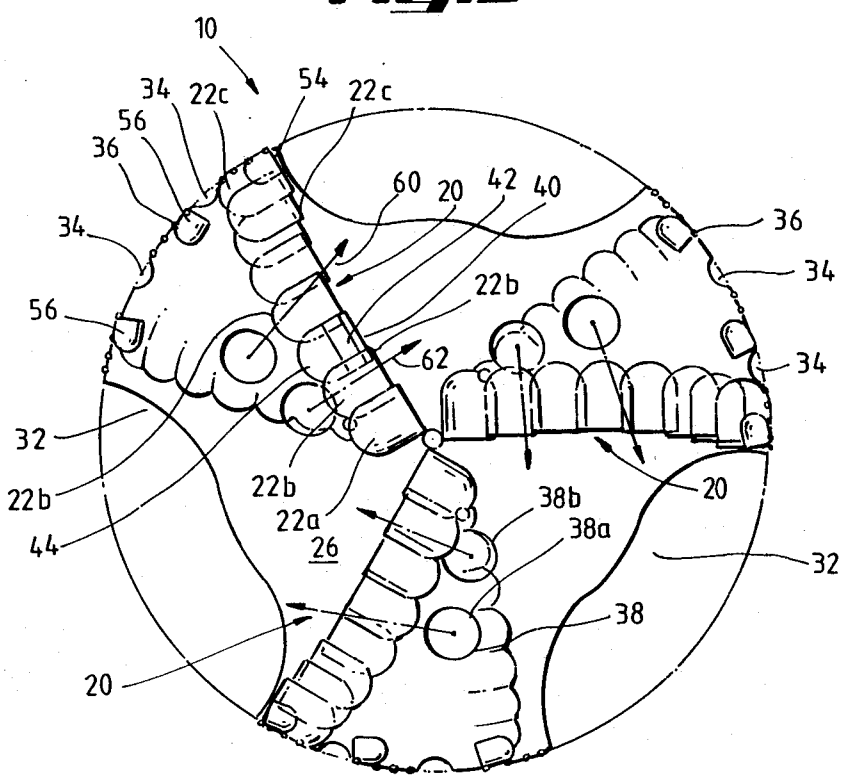
FIG. 2 is a diagrammatic plot sketch of the drill bit illustrated in FIG. 1.

As graphically depicted in FIG. 2, each of the primary cutters 22 overlaps with at least one adjacent cutter. A series of cutters 22 forms a three-dimensional arch as depicted in FIG. 1, and as more simply and graphically depicted in the profile sketch of one of blades 20 in FIG. 3. A first cutter, denoted by reference numeral 22*a* as shown in FIG. 3, is disposed near the apex portion of blade 20. It is a full circle. However, the next adjacent cutter 22*b* has been moon-cut so that it fits cutter 22*a* in a complementary manner and so that diamond tables 40 of cutters 22*a* and 22*b* are seen and act as a single diamond-only face. It should be noted that little or no matrix metal of bit 10 is presented to the rock formation in the proximity of the cutting blade. The next two adjacent cutters, also denoted by reference numeral 22*b*, have the same complementary fit as cutter 22*b* which is adjacent to cutter 22*a*. Cutters 22*c* are also moon-cut to provide a complimentary fit.

Returning to FIG. 3, it can be seen that there are four cutters 22*c* which complete the diamond arch on web 20. The radial outermost cutter 22*c* extends radially from the longitudinal center of bit 10 to the gage diameter. Further gage definition is provided by a smaller diamond slug cutter 54 placed above the radial outermost cutter 22*c* which is depicted below cutter 22*c* in FIG. 3. As better seen in the plot sketch of FIG. 2, gage cutter 54 is side raked. Additional gage definition and protection are provided by similar small slug cutters 56 which displaced at the gage of the bit behind the arch of primary cutters 22*a*–22*c* again as best depicted in FIG. 2. FIG. 3 shows that such supplementary cutters 56 longitudinally overlap the radial outermost cutter 22*c* and its corresponding gage cutter 54.

The cutter placement as just described is repeated three times in the bit, once for each blade 20, thereby providing a triple redundancy of cutters and cutting action. The degree of redundancy could of course be increased or decreased according to the number of blades used.

Blade 20 is partially characterized as depicted in FIG. 3 as forming an open web characterized by a cavity 24 which underlies the arch of primary cutters 22*a*–22*c*. As shown in FIG. 1, cavity 24 is completely open allowing free communication through each blade. However, disposed in the bottom of each blade is one or more nozzles 38 which are best depicted in FIG. 2. Nozzles 38 are placed in the base portion 58 of the web best seen in FIG. 3 which defines cavity 24 and behind the arch formed by cutters 22*a*–22*c*. In the illustrated embodiment, two sets of nozzles are provided for each blade 20. Nozzle 38a, for example, provides a directed flow as symbolically denoted by arrow 60 which fans out from behind, down and then across the diamond tables 40 of cutters 22*b*–22*c* from approximately the midpoint to the gage end of the arch of cutters. Nozzle 38*b* similarly provides a directed flow, as symbolically denoted by arrow 62, across cutters 22*a*–22*b* from the midpoint to the apex of the arch of cutters. The hydraulic flow and its coaction with chip removal is best depicted in connection with FIG. 4.

Figure 4:
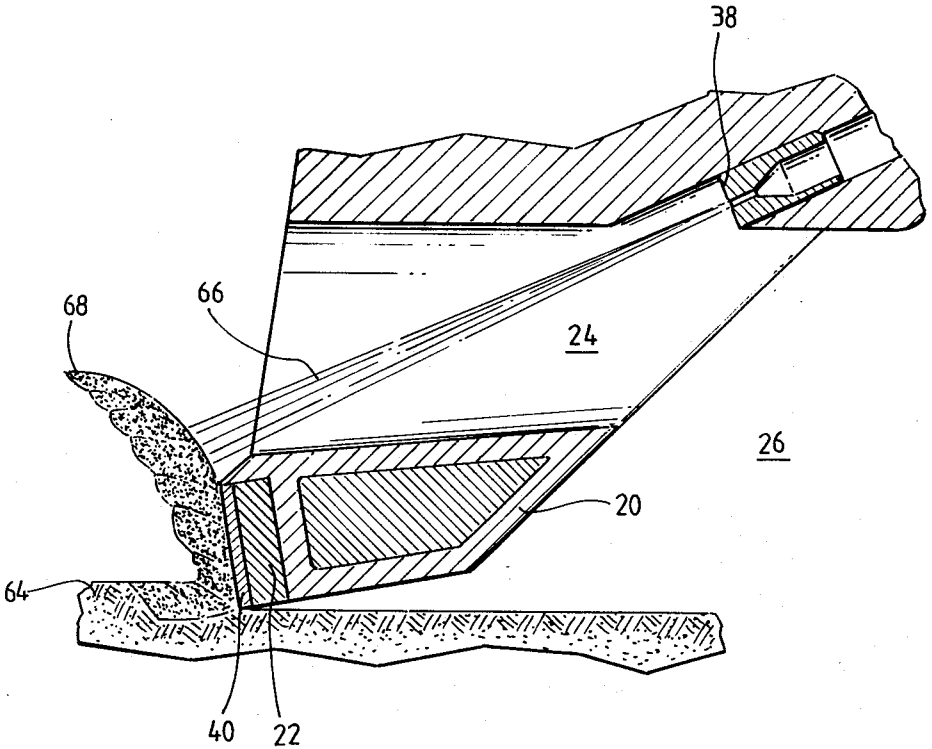
FIG. 4 is a highly diagrammatic partial cross-sectional view in enlarged scale illustrating the cutting and hydraulic action of one blade of the invention.

FIG. 4 is a diagrammatic cross-sectional view taken through cavity 24 of one of blades 20 as the bit is cutting into a formation 64. The primary cone of hydraulic flow is symbolically depicted as cone 66. The flow is ejected by nozzle 38 through cavity 24 downwardly and from behind cutters 22*a*. Chips being gouged from formation 64 are extruded upwardly across the face of diamond table 40 of cutter 22 and caught at their upper edge by the hydraulic flow contained within and adjacent to cone 66. The hydraulic flow peels chip 68 away from the face of diamond table 40. Ultimately chip 68 becomes of such a size that it separates from formation 64 and is transported by the hydraulic flow into waterways 26, face junk slots 28 and junk slots 32. The chips are entrained in the hydraulic flow up the borehole and carried to the well surface. According to the invention, chip 68 only contacts the cutting faces of diamond tables 40 and no other portion of the bit is presented for impact or driving contact with chips 68. Furthermore, chips 68 are exposed and impacted by hydraulic flow 66 from behind cutters 22. Cavities 24 are believed to act as chip breakers and to allow large chips 68 to be broken into smaller, more manageable pieces at the bit crown. The open design of bit 10 also allows a great deal of chip dynamics and turbulence to be created at the bit crown at the expense of a very limited amount of hydraulic volume. Therefore, bit 10 is able to operate at lower hydraulic volumes and pressures and to tolerate a degree of plasticity in formations that would not otherwise be possible with cutter designs allowed or permitted greater impact between chips 68 and noncutting surfaces of bit 10. Chips 68, almost regardless of their plasticity or stickiness, have very little opportunity to contact or adhere to any surface of the bit before being broken up, pressure relieved, hydrated and carried away.

The overall geometry and operation of bit 10 of the invention now having been described, consider the methodology wherein a bit according to the illustrated embodiment is manufactured. As first stated, bit 10 is manufactured using conventional metal matrix infiltration techniques. A metal blank body serves as the core of the bit, to which the blades are attached and around which the metal matrix is infiltrated. As shown in the art the blank has a generally cylindrical form comprised of a base portion which is machined at its lower end.

The bit blank, once assembled, is inserted into a conventional graphite mold (not shown) together with a number of additional carbon and sand pieces which will define cavity 24, waterways 26, face junk slot 28 and junk slot 32 among other details of the bit face. Cutters 22 will be milled or defined into the bottom of the graphite mold, and the bit blank, as described with its various carbon pieces, is aligned within the bit mold relative to the cutter blanks and other bit face features set up within the mold.

For example, in the case where nonthermally stable diamond is used on diamond tables 40 of cutters 22, dummy blanks will be placed within the mold in place of the cutting slugs and the diamond tables. After the bit is fabricated, the dummy slugs will be removed and the diamond compax slugs may then be brazed or otherwise secured to the bit at a lower temperature than the infiltration temperature, which lower temperature will not degrade the diamond.

In the case where thermally stable diamond is used in cutter 22, that is, where diamond which is thermally stable in excess of temperatures of 1200 degrees C., the diamond cutters may be directly furnaced into the bit as the metal matrix is infiltrated around the bit blank.

Gross and detailed structure of the bit depicted in FIG. 1 is formed within the filled mold by use of variously sized graphite or sand pieces and clay according to conventional infiltration molding techniques. The metal matrix is then packed into the mold according and furnaced to produce an integral and solid mass in which the blanks are embedded and otherwise hidden from view.

Many modifications and alterations may be made by those having ordinary skill in the art without departing from the spirit and scope of the invention.

Figure 6:
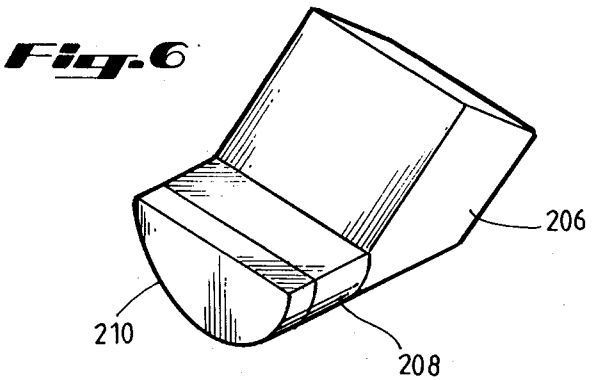
FIG. 6 is a perspective view in enlarged scale of one of the cutting slugs in the bit of FIG. 5 shown in isolation of the bit.
Figure 7:
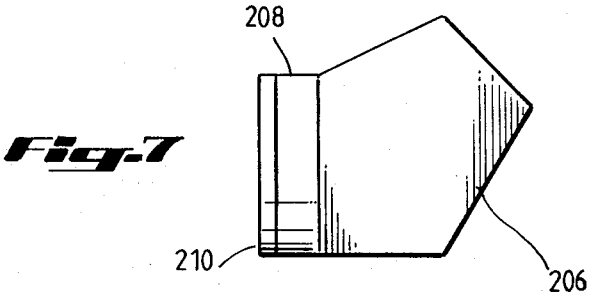
FIG. 7 is a side view of the cutter slug of FIG. 6.
Figure 5:
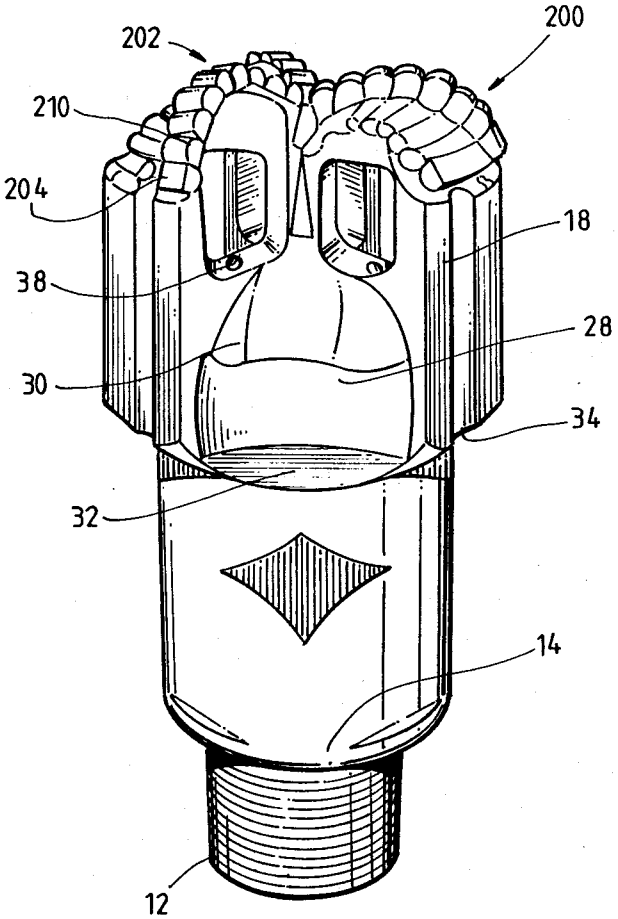
FIG. 5 is a perspective illustration of an alternative embodiment of the bit using half-round diamond cutters in the blade.

For example, although the illustrated embodiment has been described in terms of moon-cut discs many other types of cutters or cutter shapes may be employed. For example, in FIG. 5 a bit, generally denoted by reference numeral 200, is depicted wherein a plurality of semicircular diamond tables 210, which are comprised of slug cutters 202 which are made from cutters of the first embodiment which have been cut in half, are used to form the cutting elements in the blade arch. This allows relative inversion of the cutters along the gage of bit 200, as exemplified by cutter 204 as compared to cutters 210 to enhance gage definition. As best depicted in FIGS. 6 and 7 cutter 202 could be formed on tungsten carbide slugs 206 carrying a tungsten carbide backing 208 behind diamond table 210. A side view of slug 206 is depicted in FIG. 7 and a perspective view is shown in FIG. 6.

Figure 9:
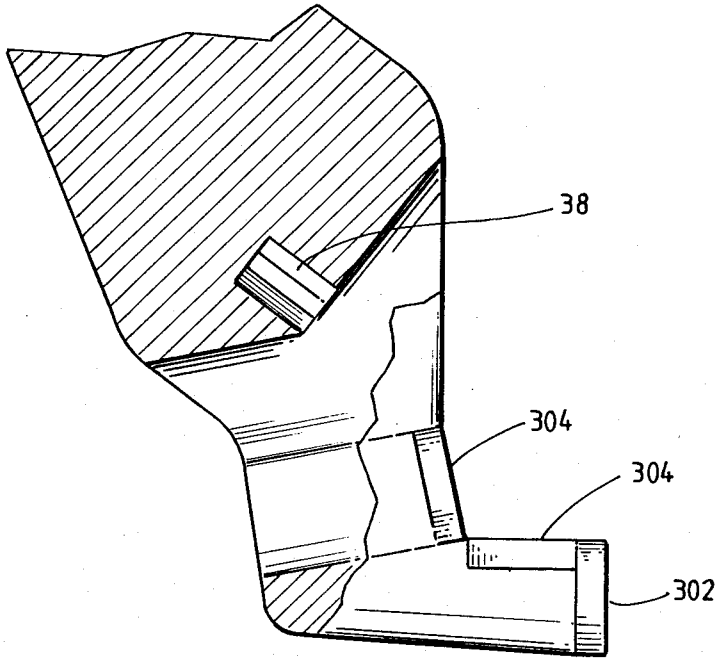
FIG. 9 is a partial diagrammatic cross-sectional view of one blade of the bit of FIG. 8.
Figure 8:
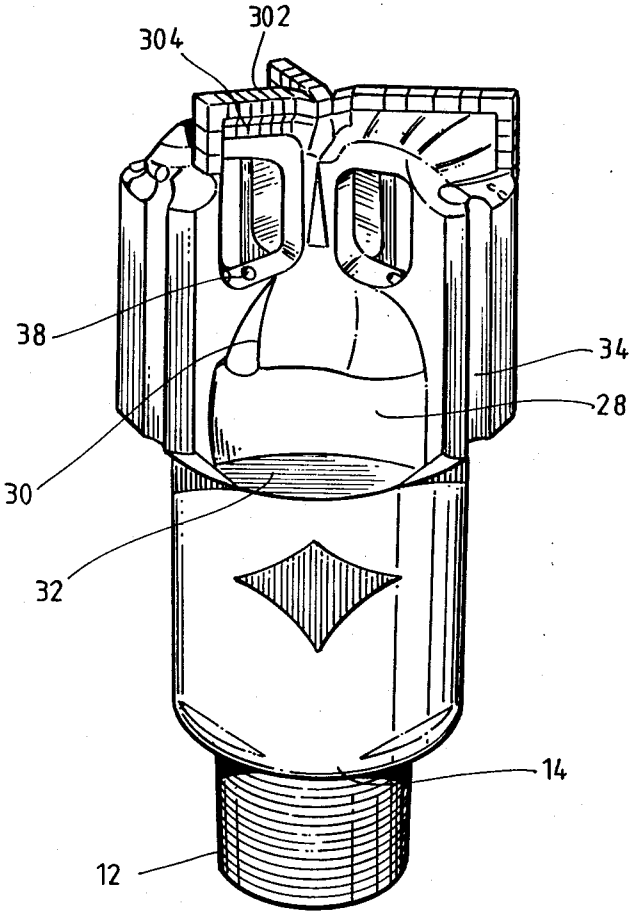
FIG. 8 is a perspective illustration of another embodiment of the invention where the cutting slugs are provided with rectangular diamond faces.

Yet another embodiment is shown in FIGS. 8 and 9 wherein rectangular diamond tables are laser cut from large cylindrical discs to provide a diamond cutting bar 302 of bit 300. Not only is an integral and diamond-only blade presented to the rock formation as shown in the perspective view of FIG. 8, but portions of the blade behind the primary surface can also be covered with diamond plates 304 in a mosaic or tile pattern as best depicted in the cross-sectional view shown in FIG. 9 of one of the blades depicted in FIG. 8.

Figure 10:
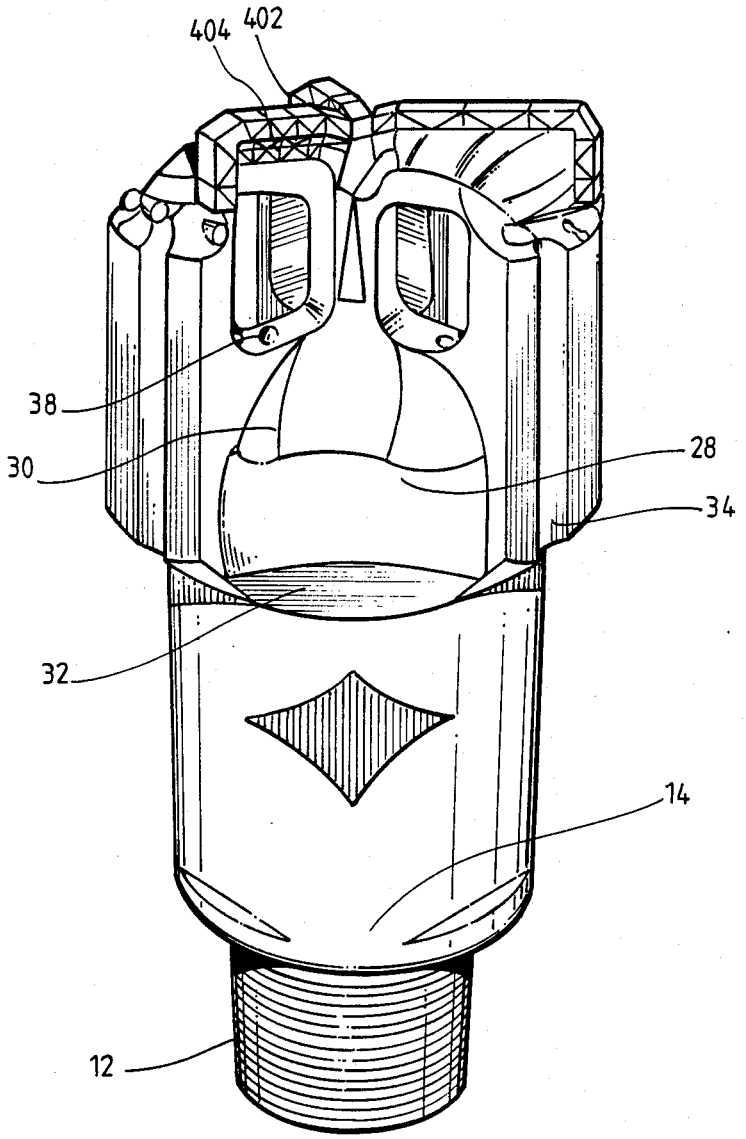
FIG. 10 is a perspective illustration of yet another embodiment of the invention wherein triangular diamond faces are combined on the blade of a bit made according to the invention.

Yet another embodiment may be devised as shown in the perspective view of FIG. 10 wherein the diamond tables of the slug cutters are formed or cut into a triangular shape to comprise cutters 402 of bit 400. Again, the only surface of the blade which is substantially exposed as a cutting surface is a diamond-only surface and no opportunity is provided to the plastic chips to adhere to any other surface of the bit.

Many other types of cutters in addition to diamond or diamond-related cutters, not known or later devised, could similarly substituted for those specifically described without departing from the spirit and scope of the invention. Moreover, different sized and shaped cavities which provide the same effect as the open toroidal cavity of the preferred embodiments may be employed. Finally, the nozzles may be placed to direct hydraulic flow across the cutting face from the side, front or other orientation.

Therefore, it must be understood that the illustrated embodiment has been shown only for the purposes of example and it should not be read as a limitation of the invention as defined in the following claims.

I claim:

1. A drill bit for drilling a borehole in an earth formation, comprising:

a bit body having connection means at the upper end thereof and a fluid passage extending therethrough from said connection means to the interior of said bit body;

at least one blade connected to said bit body therebelow and longitudinally spaced therefrom to define a cavity between said blade and said bit body;

a laterally extending cutting surface on said blade, said cutting surface having an upper extent proximate said cavity and a lower extent adapted to contact said earth formation and facing the direction of intended forward rotation of the bit; and at least one nozzle associated with said cutting surface disposed in said bit body at a location behind said cutting surface relative to the direction of intended rotation of the bit and oriented generally in the direction of said rotation to direct a flow of hydraulic fluid from said fluid passage through at least a portion of said cavity proximate the upper extent of the cutting surface.

2. The bit of claim 1, wherein said bit includes a plurality of generally radially extending blades, and wherein each blade of the plurality of blades has a first, radially outer end and a second, radially inner end, each blade having its first end independently connected to said bit body and its second end commonly connected with the second ends of the remaining blades to said bit body.

3. The bit of claim 1, wherein at least two nozzles associated with said cutting surface are disposed in said bit body, each nozzle being oriented to direct a flow of hydraulic fluid primarily proximate a different lateral portion of said cutting surface.

4. The bit of claim 2 wherein at least two nozzles are associated with each said cutting surface are disposed in said bit body, each nozzle being oriented to direct a flow of hydraulic fluid proximate a different lateral portion of its associated cutting surface.

5. The bit of claim 2 wherein at least one of said blades extends to define the gage of the borehole.

6. The bit of claim 1 wherein said cutting surface on each blade provides a substantially continuous cutting face.

7. The bit of claim 5 wherein said cutting surface comprises a plurality of cutters, selected cutters of said plurality of cutters being moon-cut to conformally engage adjacent cutters.

8. The bit of claim 5 wherein said cutting surface comprises a plurality of cutters, and wherein at least some of said cutters have a generally rectangular shape to permit conformal abutment of said rectangularly shaped cutters adjacent to each other.

9. The bit of claim 5 wherein said cutting surface comprises a plurality of cutters, and wherein at least two of said cutters have a triangular shape, said triangular-shaped cutters being inverted relative to each other to permit abutment of the side of one with an adjacent side of the other.

10. A drill bit for cutting an earth formation, comprising:

a bit body having connection means at the upper end thereof and a fluid passage extending therethrough from said connection means to the interior of said bit body;

a plurality of generally arched blades on said bit body and extending longitudinally downwardly therefrom, said blades extending from the gage of said bit generally radially inwardly to a central portion of said bit;

a corresponding plurality of open cavities longitudinally and generally radially defined between each of said arched blades and said bit body, said cavities permitting free flow of fluid and formation cuttings therethrough;

a plurality of cutters disposed on each of said arched blades;

a plurality of nozzles disposed on said bit, each of said blades having associated therewith at least one of said nozzles, said at least one nozzle being located in said bit behind the cutters on its said associated blade relative to the intended direction of rotation of the bit and oriented generally in the direction of said rotation to direct hydraulic flow from said fluid passage through at least a portion of the cavity defined between its said associated blade and across at least some of the cutters on its associated blade.

11. The drill bit of claim 10 wherein each of said cutters comprises a diamond cutting face and wherein said plurality of nozzles direct hydraulic flow across said diamond faces.

12. The drill bit of claim 11 wherein at least some of said diamond faces of said plurality of cutters are sized and shaped so that said diamond faces on said cutters conformally fit with adjacent diamond faces of adjacent cutters to present a substantially diamond-only cutting face.

13. A drill bit comprising a bit body having a fluid passage therethrough;

a plurality of generally radially extending arched blades, each blade having a first, leading side and a second, trailing side relative to the direction of intended rotation of the bit when drilling, wherein the blades are longitudinally spaced from said body and secured thereto primarily proximate their radially innermost and outermost extents;

a generally radially and circumferentially extending cavity between each said blade and said bit body opening on at least said first side of each blade;

a cutting surface on the first side of each blade below said cavity; and at least one nozzle associated with each blade, each said nozzle communicating with said fluid passage and being disposed joined to said bit body behind the first side of its associated blade relative to said direction of intended rotation and generally oriented in the direction of said rotation.

14. A method for preventing bit balling in the cutting of a plastic rock formation with a drill bit, comprising the steps of:

providing a bit having a bit body, a cutting surface and a cavity defined between the bit body and the cutting surface;

rotating said drill bit;

presenting substantially only said cutting surface to said plastic rock formation;

cutting said plastic rock formation with said cutting surface; and removing rock cuttings cut by said cutting surface from said cutting surface by directing hydraulic flow through the cavity to a portion of said cutting surface most removed from said plastic formation from a nozzle positioned behind said cutting surface as defined by the direction of rotation of said drill bit.

15. The method of claim 14 wherein said step of removing rock cuttings includes impinging said hydraulic flow on said cuttings as said cuttings clear said cutting surface and extend thereabove.

16. The method of claim 14 wherein said step of removing rock cuttings includes transporting said rock cuttings into said cavity and thereafter into an annulus between said bit and a borehole in which said bit is disposed.

17. The bit of claim 13, wherein said cavities extend between said first and second blade sides of at least some of said blades.

18. The bit of claim 17, wherein said nozzles are disposed behind said second blade sides of their associated blades.

19. The bit of claim 13, wherein said cavities are circumferentially aligned and all of similar dimensions and extend between said first and second blade sides of each blade to form a continuous toroidal space between said bit body and said blades.

* * * * *